US005123305A

United States Patent [19]

Williams

[11] Patent Number: 5,123,305

[45] Date of Patent: Jun. 23, 1992

[54] CAP WRENCH FOR PORTABLE FIRE EXTINGUISHER

[76] Inventor: Garfield Williams, P.O. Box 771536, Steamboat Springs, Colo. 80477

[21] Appl. No.: 713,386

[22] Filed: Jun. 7, 1991

[51] Int. Cl.[5] ..... B67B 7/18

[52] U.S. Cl. ..... 81/3.4; 81/177.1; D8/27; D8/23

[58] Field of Search ..... 81/3.07, 3.4, 176.1, 81/176.15, 177.1, 177.5, 124.3, 124.4; D8/17, 18, 27, 33, 40

[56] References Cited

U.S. PATENT DOCUMENTS

| | | | |
|---|---|---|---|
| 37,865 | 3/1863 | Griswold | 81/124.4 |
| 279,993 | 6/1883 | True | 81/177.5 |
| 305,767 | 9/1884 | True | 81/177.5 |

FOREIGN PATENT DOCUMENTS

| | | | |
|---|---|---|---|
| 0741638 | 2/1933 | France | 81/177.5 |
| 0139098 | 2/1920 | United Kingdom | 81/176.1 |
| 0182687 | 7/1922 | United Kingdom | 81/176.1 |

*Primary Examiner*—Roscoe V. Parker

*Attorney, Agent, or Firm*—Charles C. Corbin

[57] ABSTRACT

A wrench for use on the fill cap for a portable fire extinguisher, the cap being threadedly attached to the top of the fire extinguisher, and being generally cylindrical with an externally threaded lower portion and an upper portion characterized by a diametrically extending flat surface, and an upwardly projecting indicator element at the middle of the flat surface, and a pair of raised portions on each side of the flat surface that provide spaced-apart upright surfaces that form a slot at opposite ends of the flat surface, the wrench being adapted to loosen or tighten such a cap, and having a socket portion with an opening adapted to loosely receive therein the indicator element and a first generally flat elongated handle extending from one side of the socket element and a socket arm extending from the opposite side of the socket element whereby the first and second handles are adapted to engage the flat surface as the indicator element is received within the socket element, and whereby the wrench can be turned to engage the walls of the slots in order to rotate the cap.

6 Claims, 1 Drawing Sheet

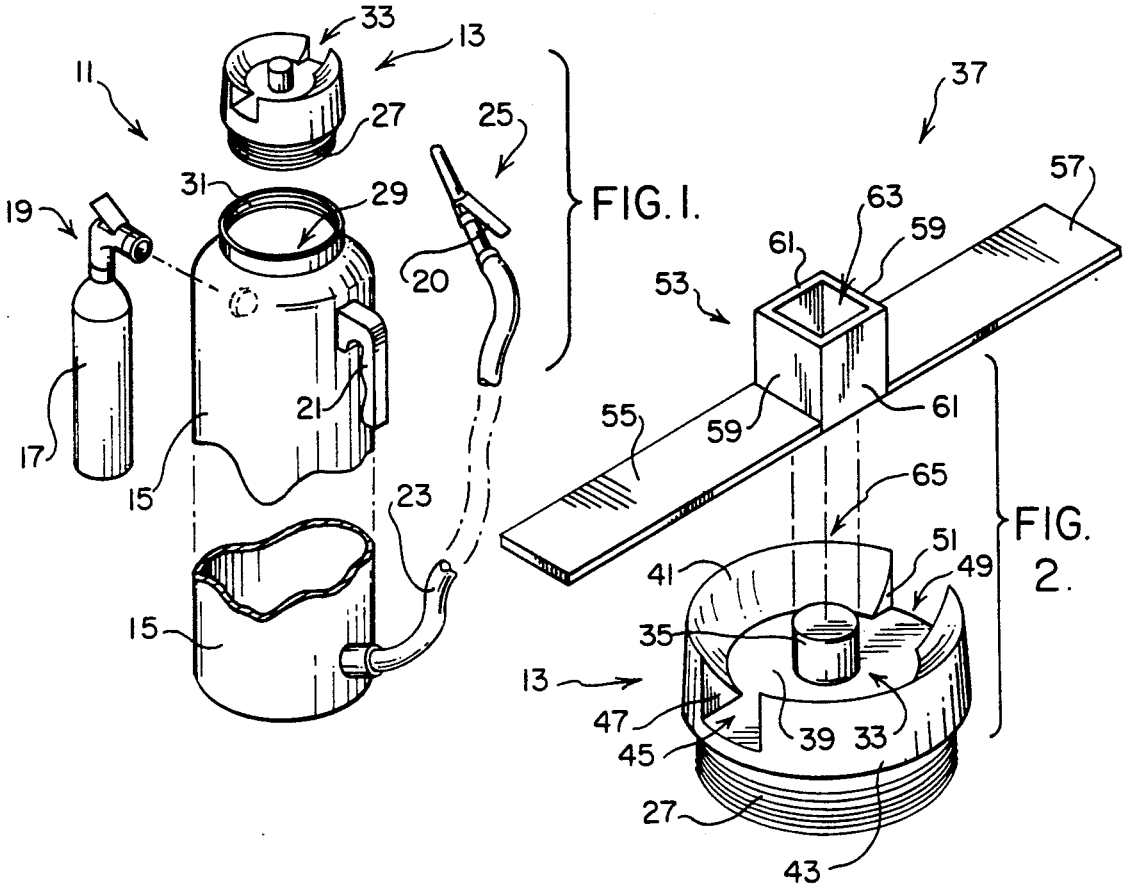
33
13
11
27
25
31
29
19
20
21
17
15
23
15
FIG. 1.
37
57
63
59
61
53
55
59
61
65
51
49
41
35
13
47
45
39
33
27
43
FIG. 2.
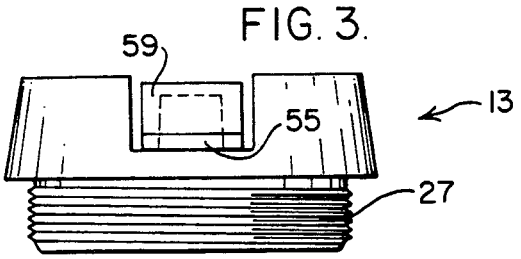
FIG. 3.
59
55
13
27
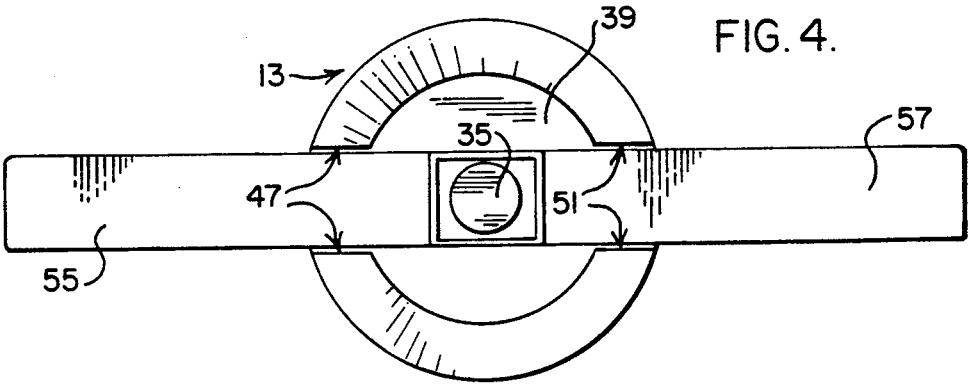
39
FIG. 4.
13
35
57
47
51
55

CAP WRENCH FOR PORTABLE FIRE EXTINGUISHER

BACKGROUND OF THE INVENTION

1. Field of the Invention

The present invention relates to a wrench for a fill cap for a portable fire extinguisher of the dry-chemical type, and particularly relates to a wrench for a fill cap with an upwardly projecting pressure indicator member.

2. Description of the Prior Art

A portable fire extinguisher consists of a container for an extinguishing agent, a pressure-producing device, and a mechanism such as a hose and a nozzle, for discharging and directing the extinguisher contents as required. The first modern portable fire extinguisher consisted of a metal cylinder filled with a solution of sodium bicarbonate and water beneath a container of sulfuric acid. When the extinguisher was inverted, the acid mixed with the solution to form carbon dioxide gas, which provided the pressure to expel the liquid through a hand-held hose.

Although such extinguishers represented a great improvement in fire fighting at the time of their introduction, they had many drawbacks and limitations. These earlier extinguishers were suitable only for certain types of fires such as Class A fires that involve ordinary combustibles such as paper, wood and cloth. These extinguishers have been substantially replaced by the multipurpose, dry-chemical extinguisher that is effective on a wide range of fires including the fire classifications A, B, C and D as defined by the National Fire Protection Association. A typical modern multi-purpose dry-chemical extinguisher includes a steel tank or shell that can hold a quantity of dry-chemical, a pressure cartridge such as a $CO_2$, cartridge that is mounted to the exterior of the tank, and which $CO_2$, cartridge is connected by a controlling valve to the tank, for the purpose of pressurizing and "fluidizing" the dry contents of the reservoir when required. The fill cap is generally cylindrical in configuration and covers an opening of relatively large diameter in the top of the tank, the cap having external threads that engage the threaded opening in the tank top. When the cap is unscrewed and removed, the tank may be filled with an initial charge of selected fire-retardant dry chemical. When the extinguisher is used in fighting a fire and its dry chemical contents discharged, it is necessary to return the extinguisher to operational condition be refilling it with a certain amount of dry chemical, and providing a fresh $CO_2$ cartridge. Thus, it is necessary to remove and then reattach the fill cap for the refilling of a unit. Popular designs of dry-chemical fire extinguishers that employ such fill caps are available under the trademarks Ansul, Redline, and others including General and Badger.

The upper part of such a fill cap is characterized by a diagonally extending flat surface and spaced-apart upward projections on opposite sides of the flat surface. The spacing between these upward projections provide a slot at each end of the diagonally extending flat surface, and in preferred models, there is an upwardly projecting cylindrical indicator at the center of the cap and in the middle of the flat surface. This indicator is mounted to the cap so as to move from a normal raised position to a lowered position which indicates that the extinguisher has been discharged, with a resulting loss in pressure, and is in need of servicing.

The above discussed multi-purpose extinguisher is maintained and serviced by certified individuals who are in need of an improved way for accomplishing their tasks in a reliable as well as quick and efficient manner. The drawback is the lack of a tool, device or fixture that is adept at loosening or tightening the fill cap described above. One device that is commonly used for this purpose includes a flexible strap that can embrace the cylindrical walls of the cap. While devices can be used to turn a cap, they can be unwieldly use, and require careful preparation and cleaning of engaging surfaces of both the cap and the strap in to prevent slippage. Another technique that is sometimes employed is the use of a hammer or similar tool in conjunction with a large screwdriver or the like to torque the cap in the desired direction by appropriately hammering the screw lever into the cap. Such practices are unsafe, noisy, unreliable, time consuming and can lead to damage of the extinguisher.

SUMMARY OF THE INVENTION

In view of the aforementioned shortcomings of the prior art it is a general object of the present invention to provide improved means for loosening and tightening the fill cap of a portable fire extinguisher.

Another object of the present invention is to provide loosening and tightening tool for a fire extinguisher fill cap that is highly effective and reliable.

Yet another object of the invention is to provide a fill cap wrench that lends itself to economically manufacturing techniques.

Still another object of the invention is to provide a fill cap wrench that is relatively inexpensive.

These and other objects and advantages may be provided by the present invention which is a wrench construction adapted for use with a fill cap that is generally cylindrical with a lower portion that is threaded, and which has a top portion featuring a diagonally extending, generally flat surface that is bordered by two spaced-apart upward projections with an indicator element projecting upwardly from the midpoint of the diagonal surface. The invention includes a wrench having a lower surface adapted to engage the diagonal surface of the cap, including a socket portion with walls defining an opening for loosely receiving the indicator element therethrough, and a first elongated handle extending from one side of the socket element, and a second elongated handle extending from the other side of the element, whereby the wrench is adapted to engage the cap with the indicator element received in the socket portion, the first and second handles engaging the diagonal surface and upright edges of the spaced-apart upward projections for torque-transmitting engagement with the cap so as to turn the cap about its axis. In a preferred embodiment the handles are generally flat elongated bars.

BRIEF DESCRIPTION OF THE DRAWINGS

FIG. 1 is a partial, fragmented perspective view illustrating a portable, multi-purpose fire extinguisher having a fill cap for which the wrench of the present invention is applicable;

FIG. 2 is a view in perspective illustrating a fill cap and a preferred embodiment of a wrench therefore according to the present invention;

FIG. 3 is a side elevational view of a fill cap that can be turned by a wrench according to the present invention; and FIG. 4 is a top, plan view illustrating use of a wrench according to the present invention.

DETAILED DESCRIPTION OF THE INVENTION

Referring now to the drawings, FIG. 1 shows a conventional multi-purpose dry-chemical portable fire extinguisher 11, which fire extinguisher 11 is equipped with a fill-cap 13 for which the novel wrench of the invention, to be described, can be advantageously employed. Note that the illustrated extinguisher 11 includes a steel tank 15, a $CO_2$ cartridge 17 that is controlled by valve 1 for pressurizing the interior of the tank 15 when required, a carrying handle 21, and a discharge hose 23 to which is affixed a valve-controlled nozzle 25.

As FIG. 2 best shows, the lower portion of cap 13 is externally threaded at 27. The top of vessel 15 is provided with a large diameter fill-opening at 29 which is suitably threaded to allow attachment of the fill-cap 13. A suitable gasket or seal (not shown) ensures that a gas-tight seal is achieved when a fill-cap 13 is tightened in place.

When a portable fire extinguisher 11 is fully charged and operational, the tank 15 will contain a predetermined amount of dry chemical material. On the occasion of the use of extinguisher 11 in a fire fighting event the $CO_2$ cartridge 17 is caused to pressurize the vessel by the tripping of a valve 19. $CO_2$ and dry chemical will be discharged via the hose and nozzle by operating the nozzle valve 20. To provide added safety, security and reliability, it is preferred in many designs to equip the fill-cap 13 with a pressure indicator 33, shown in FIGS. 1 through 4. This informative device helps preserve the reliability of the fire-fighting system by ensuring that non-operational units are easily detected and promptly serviced since at lower pressure levels the extinguisher will not operate effectively. The indicator 33 includes a projection 35 that is mounted for movement to a lowered position when pressure within the cylinder 15 is too low. It is on these occasions that fire extinguisher 11 requires maintenance and service which would include the replacement of the $CO_2$ cartridge as well as a reloading of dry chemical into the tank 15. This requires removal of the fill-cap 13 in order to expose opening 29 through which the interior of tank 15 may be cleaned and through which a certain quantity of dry chemical can be loaded. When tank 15 has been filled it is necessary to reapply fill-cap 13 and to screw it safely, quickly and easily, with sufficient torque to give the required seal.

It is a cap wrench 37, a preferred embodiment constructed according to the present invention, and illustrated in FIGS. 2, 3 and 4, that is herein provided as a tool to accomplish tightening and loosening of cap 13 in an advantageous manner to achieve the aforementioned objects of the invention. Wrench 37 and its use will be described in further detail hereinafter following further description of the upper portion of filler-cap 13. Accordingly, note that the upper portion of fill-cap 13 is characterized by a flat, generally diagonally extending surface 39, with indicator 35 projecting from the middle thereof as shown. There is also a first upward projection 41 which is spaced from a second upward projection 43. Note that these upward projections provide at one end of surface 39 a slot 45 between opposing, spaced-apart surfaces 47. At the other side of surface 39 lies a second slot 49 between spaced-apart upright surfaces 51, also shown in FIG. 4.

Proceeding now with a description of cap-wrench 37, which is a preferred embodiment of the invention, note that it is fabricated of suitable steel stock according to well-known techniques in the metal fabrication industry. As FIG. 2 shows the main components of cap-wrench 37 are a socket portion 53 and handles 55 and 57. Note that the socket portion 53 includes spaced-apart walls 59, and a second set of walls 61. These socket walls define a vertically extending channel 63.

The first handle 55, resembling generally flat bar stock and as wide as the socket portion 53, is rigidly secured perpendicularly to the lower part of a socket wall 59 by welding or other suitable means. By reference to FIG. 4 it will be appreciated that handle 55 is chosen sufficiently long to allow it, when applied to a cap in a manner to be described, to be grasped by one hand. The second handle 57 has dimensions that match the first handle 55 and is similarly affixed by welding means to the lower end of the other wall 59 and designed to be grasped by one's other hand. It will also be appreciated that the overall length of wrench 37 will be chosen so as to provide the user with appropriate leverage and mechanical advantage for easy and effective use. The lower surfaces of handles 55 and 57, and socket portion 53 all lie in the same general plane. It is further noted that channel 63 is sufficiently large so that the indicator 35 can be received therein in a loose, non-binding manner. Also note that the widths of handles 57 and 55 are preferably slightly less than the widths of fill-cap slots 45 and 49 so that they can be received therein when the wrench is applied to cap 13.

FIG. 2 and 4 illustrate the application of wrench 37 to a cap 13. When wrench 37 is applied as shown in FIG. 4 the indicator projection 35 is not interfered with, and the flat bottom surfaces of wrench 37 will lie in flush engagement with the generally flat diagonal surface 39. Also note how handle 55 lies between spaced-apart surfaces 47 and handle 57 lies between spaced-apart surfaces 51. Thusly positioned, rotation of wrench 37 about the rotational axis 65 of fill-cap 13 will bring side edges of the handle 55 and 57 into torque-transmitting engagement with a surface 47 and a surface 51.

While one particular preferred embodiment is shown in FIGS. 2, 3 and 4 it should be appreciated by those with ordinary skill in the art, that the scope of the present invention will include variations, all of which are structured to carry out the operational principles according to the present invention. For example, within the scope of the invention, the socket portion of the wrench may take on other, equivalent configurations, such as a hollow cylinder. Thus it is aimed to cover all such changes and modifications that fall within the true spirit and scope of the invention.

What is claimed is:

1. A wrench for loosening and tightening a fire extinguisher cap, said cap being generally cylindrical and having a lower portion adapted to threadedly engage an opening in the top of said fire extinguisher and said cap having an upper portion characterized by a diametrically extending flat surface, an upwardly projecting indicator element at the middle of said flat surface, and a pair of raised portions on each said flat surface that provide spaced-apart upright surfaces that form a first slot at one end of said flat surface, and a second slot at the opposite end of said flat surface, said wrench including:

a) an open socket element adapted to loosely receive therein said indicator element; a first, elongated handle affixed to the lower end of said socket element extending from, one side thereof and adapted to be received in one of said cap slots; and a second, elongated handle affixed to the same end of said socket element and extending from the opposite side thereof and receivable in the other of said cap slots, wherein said first and second handles have generally flat bottom surfaces adapted to engage said diametrically extending flat surface of said cap, and whereby said wrench is turnable about the axis of said cap to engage the walls of said slots in order to rotate said cap.

2. A wrench as defined in claim 1 wherein said first handle and said second handle each has a length that is substantially greater than the radius of said diametrically extending flat surface.

3. A wrench as defined in claim 1 wherein each of said handles is adapted to be grasped by a hand.

4. A wrench as defined in claim 1 wherein said socket element has an opening with a generally square configuration.

5. A wrench as defined in claim 1 wherein said socket element has a generally rectangular cross-sectional configuration.

6. A wrench as defined in claim 1 wherein said socket element has a tubular configuration.

* * * * *